US009426566B2

(12) United States Patent
Takahashi

(10) Patent No.: US 9,426,566 B2
(45) Date of Patent: Aug. 23, 2016

(54) APPARATUS AND METHOD FOR SUPPRESSING NOISE FROM VOICE SIGNAL BY ADAPTIVELY UPDATING WIENER FILTER COEFFICIENT BY MEANS OF COHERENCE

(75) Inventor: Katsuyuki Takahashi, Tokyo (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 672 days.

(21) Appl. No.: 13/597,820

(22) Filed: Aug. 29, 2012

(65) Prior Publication Data

US 2013/0066628 A1 Mar. 14, 2013

(30) Foreign Application Priority Data

Sep. 12, 2011 (JP) ..... 2011-198728

(51) Int. Cl.

*G10L 21/00* (2013.01)
*G10L 21/02* (2013.01)
*H04R 3/00* (2006.01)

(52) U.S. Cl.

CPC ..... *H04R 3/005* (2013.01)

(58) Field of Classification Search

None
See application file for complete search history.

(56) References Cited

U.S. PATENT DOCUMENTS 5,209,237 A * 5/1993 Rosenthal ..... G06K 9/0051 367/45
5,337,180 A * 8/1994 Woods ..... G02B 27/46 359/299
6,446,008 B1 * 9/2002 Ozbek ..... G01V 1/364 367/45
8,363,850 B2 * 1/2013 Amada ..... G10L 19/008 381/92
8,503,695 B2 * 8/2013 Chilakapati ..... H03M 1/1019 341/118
8,503,697 B2 8/2013 Amada
8,755,546 B2 * 6/2014 Terada ..... H04R 25/407 367/119
8,949,120 B1 * 2/2015 Every ..... G10L 21/0208 381/71.1
2003/0022217 A1 * 1/2003 Ceccardi ..... C07K 14/47 435/6.16

(Continued)

FOREIGN PATENT DOCUMENTS

JP 2002-204493 A 7/2002
JP 2008-311866 A 12/2008

(Continued)

OTHER PUBLICATIONS

Liu et al., "A two-microphone dual delay-line approach for extraction of a speech sound in the presence of multiple interferers," Beckman Institute for Advanced Science and Technology, University of Illinois at Urbana-Champaign, J. Acoustic Society Am., vol. 110, No. 6, Dec. 2001.*

(Continued)

*Primary Examiner* — Richemond Dorvil
*Assistant Examiner* — Thuykhanh Le
(74) *Attorney, Agent, or Firm* — Rabin & Berdo, P.C.

(57) ABSTRACT

A voice signal processor detects background noise sections to reflect characteristics of the background noise on the Wiener filter coefficient to be used for suppressing noise components of input voice signals. In the voice signal processor, directivity signal generators form directivity signals having a directivity pattern. The directivity signals are used by a coherence calculator to obtain coherence, which is in turn used by a targeted voice section detector to detect a targeted voice section. A background noise section detector detects background noise sections containing no voice signal. When a background noise section is detected, a WF adapter uses characteristics of background noise in the detected temporal section to calculate a new WF coefficient.

12 Claims, 9 Drawing Sheets

(56) References Cited

U.S. PATENT DOCUMENTS

| | | | | |
|---|---|---|---|---|
| 2003/0147538 | A1* | 8/2003 | Elko | H04R 3/005 381/92 |
| 2004/0054528 | A1* | 3/2004 | Hoya | G06K 9/0051 704/211 |
| 2005/0060142 | A1* | 3/2005 | Visser | G10L 21/0208 704/201 |
| 2006/0020454 | A1* | 1/2006 | Gerber | H04R 25/554 704/233 |
| 2007/0033020 | A1* | 2/2007 | Francois | G10L 21/0208 704/226 |
| 2007/0201588 | A1* | 8/2007 | Loiseau | H04B 1/123 375/346 |
| 2008/0159559 | A1* | 7/2008 | Akagi | G10L 21/0208 381/92 |
| 2009/0012783 | A1* | 1/2009 | Klein | G10L 21/0208 704/226 |
| 2009/0060222 | A1* | 3/2009 | Jeong | H04R 1/406 381/92 |
| 2009/0175466 | A1* | 7/2009 | Elko | H04R 3/005 381/94.2 |
| 2010/0246844 | A1* | 9/2010 | Wolff | G10L 21/02 381/66 |
| 2011/0264447 | A1* | 10/2011 | Visser | G10L 25/78 704/208 |
| 2011/0305345 | A1* | 12/2011 | Bouchard | G10L 21/0208 381/23.1 |
| 2013/0054231 | A1* | 2/2013 | Jeub | H04R 3/005 704/226 |

FOREIGN PATENT DOCUMENTS

| | | | |
|---|---|---|---|
| JP | 2010-232717 | A | 10/2010 |
| WO | WO 2011-048813 | A1 | 4/2011 |

OTHER PUBLICATIONS

Laska, B.N.M.; Bolic, M.; Goubran, R.A., "Coherence-assisted Wiener filter binaural speech enhancement," Instrumentation and Measurement Technology Conference (I2MTC), 2010 IEEE , vol., No., pp. 876,881, May 3-6, 2010.*

B. N. M. Laska, M. Boli¿ and R. A. Goubran, "Coherence-assisted Wiener filter binaural speech enhancement," Instrumentation and Measurement Technology Conference (I2MTC), 2010 IEEE, Austin, TX, 2010, pp. 876-881.*

Klaus Uwe Simmer, Sven Fischer, Alexander Wasiljeff, "Suppression of coherent and incoherent noise using a microphone array," Annales Des Telecommunicatins, Jul. 1994, 49-439.*

Chen Liu et al., "A two-microphone dual delay-line approach for extraction of a speech sound in the presence of multiple interferers," Beckman Institute for Advanced Science and Technoloty, University of Illinois at Urbana-Champaign, Urbana, Illinois 61801, J. Acoust. Soc. Am., vol. 110, No. 6, Dec. 2001.*

Japanese Office Action with translation dated Jan. 20, 2015.

* cited by examiner

APPARATUS AND METHOD FOR SUPPRESSING NOISE FROM VOICE SIGNAL BY ADAPTIVELY UPDATING WIENER FILTER COEFFICIENT BY MEANS OF COHERENCE

BACKGROUND OF THE INVENTION

1. Field of the Invention

The present invention relates to an apparatus and a method for processing voice signals, and more particularly to such an apparatus and a method applicable to, for example, telecommunications devices and software treating voice signals for use in, e.g. telephones or teleconference systems.

2. Description of the Background Art

As a noise suppression scheme, available is the voice switch, which is based upon a targeted voice section detection in which from input signals temporal sections are determined in which a targeted speaker is talking, i.e. "targeted voice sections", to output signals in targeted voice sections as they are while attenuating signals in temporal sections other than targeted voice sections, i.e. "untargeted voice sections". For example, when an input signal is received, a decision is made on whether or not the signal is in a targeted voice section. If the input signal is in a targeted voice section, then the gain of the voice section, or targeted voice section, is set to 1.0. Otherwise, the gain is set to an arbitrary positive value less than 1.0 to amplify the input signal with the gain to thereby attenuate the latter to develop a corresponding output signal.

As another noise suppression scheme, the Wiener filter approach is available, which is disclosed in U.S. patent application publication No. US 2009/0012783 A1 to Klein. According to Klein, background noise components contained in input signals are suppressed by determining untargeted voice sections, from which noise characteristics are estimated for the respective frequencies to calculate, or estimate, Wiener filter coefficients based on the noise characteristics to multiply the input signal by the Wiener filter coefficients.

The voice switch and the Wiener filter can be applied to a voice signal processor for use in, e.g. a video conference system or a mobile phone system, to suppress noise to enhance the quality of voice communication.

In order to apply the voice switch and the Wiener filter, it is necessary to distinguish targeted voice sections from untargeted voice sections, which may include "disturbing voice" uttered by a person other than the targeted speaker and/or "background noise" such as office or street noises. To take an example of distinction method available, the targeted/untargeted voice sections may be distinguished by means of a property known as coherence. In the context, coherence may be defined as a physical quantity depending upon an arrival direction in which an input signal is received. In an application of cellular phones, for example, targeted voices are distinguishable from untargeted voices in arrival directions so that the targeted voice, or speech sound, arrives from the front of a cellular phone set whereas among untargeted voice disturbing voice tends to arrive in directions other than the front and background noise is not distinctive in arrival direction. Accordingly, targeted voices can be discriminated from untargeted voices by focusing on the arrival directions thereof.

It will now briefly be described why coherence may be used in order to discriminate targeted voice sections from untargeted voice sections. In a normal detection of targeted voice sections, targeted voice sections may be discriminated from untargeted voice sections based on fluctuation in level of an input signal. In this method, it is impossible to discriminate between disturbing voice and targeted voice and, therefore, disturbing voice cannot be suppressed by the voice switch. Thus, the untargeted voice suppression will be insufficient. By contrast, in a detection relying on coherence, discrimination is made using the arrival directions of input signals. Hence, it is possible to discriminate between targeted and disturbing voices which arrive from the directions distinctive from each other. The untargeted voice suppression can effectively be attained by means of the voice switch.

When using the voice switch together with the Wiener filter, more effective noise suppression could be attained than where both measures are used separately since the voice switch effectively suppresses untargeted voice sections and simultaneously the Wiener filter effectively suppresses noise components involved in targeted voice sections.

Although the voice switch and the Wiener filter are classified into a noise suppressing technique, they are different in noise sections to be detected for the purpose of optimal operation. It is sufficient for the voice switch to have the capability of detecting untargeted voice sections which contain either or both of disturbing voice and background noise. By contrast, the Wiener filter has to detect temporal sections only containing background noise, or "background noise sections", among untargeted voice sections. Because, if a filter coefficient were adapted in a disturbing voice section, then the character of "voice" that disturbing voice contains would also be reflected on a Wiener filter coefficient which should have been applied to noise, thus causing even voice components targeted voice contains to be suppressed so as to deteriorate the sound quality.

As described so far, when the voice switch and Wiener filter are used in combination, their respectively optimal temporal sections would have to be detected. In spite of this, in the prior art, the same reference was applied between the voice switch and the Wiener filter for detecting untargeted voice sections, raising a problem that a Wiener filter coefficient reflected form the characteristics of disturbing voice may deteriorate targeted voice.

This problem could be solved by using plural schemes in parallel which are respectively appropriate for a voice switch and a Wiener filter for detecting untargeted voice sections to thereby detect appropriate temporal sections. In this case, the amount of computation would be increased. In addition, adjustment would have to be made on plural parameters behaving differently from each other, raising a further problem that the user of the system would further be burdened with computation.

SUMMARY OF THE INVENTION

It is an object of the present invention to provide an apparatus and a method for processing voice signals by appropriately using coherence obtained from background noise sections to adaptively update a Wiener filter coefficient in higher accuracy without extensively burdening the user, thus being improved in sound quality.

In accordance with the present invention, an apparatus for suppressing a noise component of an input voice signal comprises: a first directivity signal generator calculating a difference in arrival time between input voice signals to form a first directivity signal having a directivity pattern substantially being null in a first direction; a second directivity signal generator calculating a difference in arrival time between the input voice signals to form a second directivity signal having a directivity pattern substantially being null in a second direction; a coherence calculator using the first and second directivity signals to obtain coherence; a targeted voice section detector making a decision based on the coherence on whether the input voice signal is in a targeted voice section including a voice signal arriving from a targeted direction or in an untargeted voice section including a voice signal arriving from an untargeted direction different from the targeted direction; a coherence behavior calculator obtaining information on a difference of an instantaneous value of the coherence from an average value of the coherence; a Wiener filter (WF) adapter comparing difference information obtained in the coherence behavior calculator with a predetermined threshold value to determine a temporal section in the untargeted voice section as a background noise section including a signal of background noise substantially containing no disturbing voice signal, the WF adapter using, when the temporal section currently determined is a background noise section, signal characteristics of the signal in the background noise section to calculate a new WF coefficient; and a WF coefficient multiplier multiplying the input voice signal by the WF coefficient from the WF adapter.

In accordance with an aspect of the present invention, a method for suppressing a noise component of an input voice signal by a voice signal processor comprises: calculating by a signal generator a difference in arrival time between input voice signals to form a first directivity signal having a directivity pattern substantially being null in a first direction; calculating by the signal generator a difference in arrival time between input voice signals to form a second directivity signal having a directivity pattern substantially being null in a second direction; using the first and second directivity signals by a coherence calculator to calculate coherence; making by a target voice section detector a decision based on the coherence on whether the input voice signal is in a temporal section of a targeted voice signal arriving from a targeted direction at a targeted direction or in an untargeted voice section at an untargeted direction; obtaining difference information on a difference of an instantaneous value of the coherence from an average value of the coherence by a coherence behavior calculator; comparing by a Wiener filter (WF) adapter the difference information with a predetermined threshold value to detect a background noise section from an untargeted voice section to determine a temporal section in the untargeted voice section as a background noise section including a signal of background noise substantially containing no voice signal, and using, when the temporal section currently checked is a background noise section, signal characteristics of the signal in the background noise section to calculate a new WF coefficient; updating the WF coefficient when the new WF coefficient is obtained; and multiplying the input voice signal by the WF coefficient by a WF coefficient multiplier.

In accordance with another aspect of the invention, there is provided a non-transitory computer-readable medium on which is stored a program for having a computer operate as a voice signal processor, wherein the program, when running on the computer, controls the computer to function as the apparatus for suppressing a noise component of an input voice signal described above.

According to the present invention, the apparatus and method for processing voice signals are improved in sound quality by using coherence in detecting background noise with higher accuracy in adaptively updating a Wiener filter coefficient without excessively burdening the user.

BRIEF DESCRIPTION OF THE DRAWINGS

The objects and features of the present invention will become more apparent from consideration of the following detailed description taken in conjunction with the accompanying drawings in which.

DESCRIPTION OF THE PREFERRED EMBODIMENTS

Figure 1:
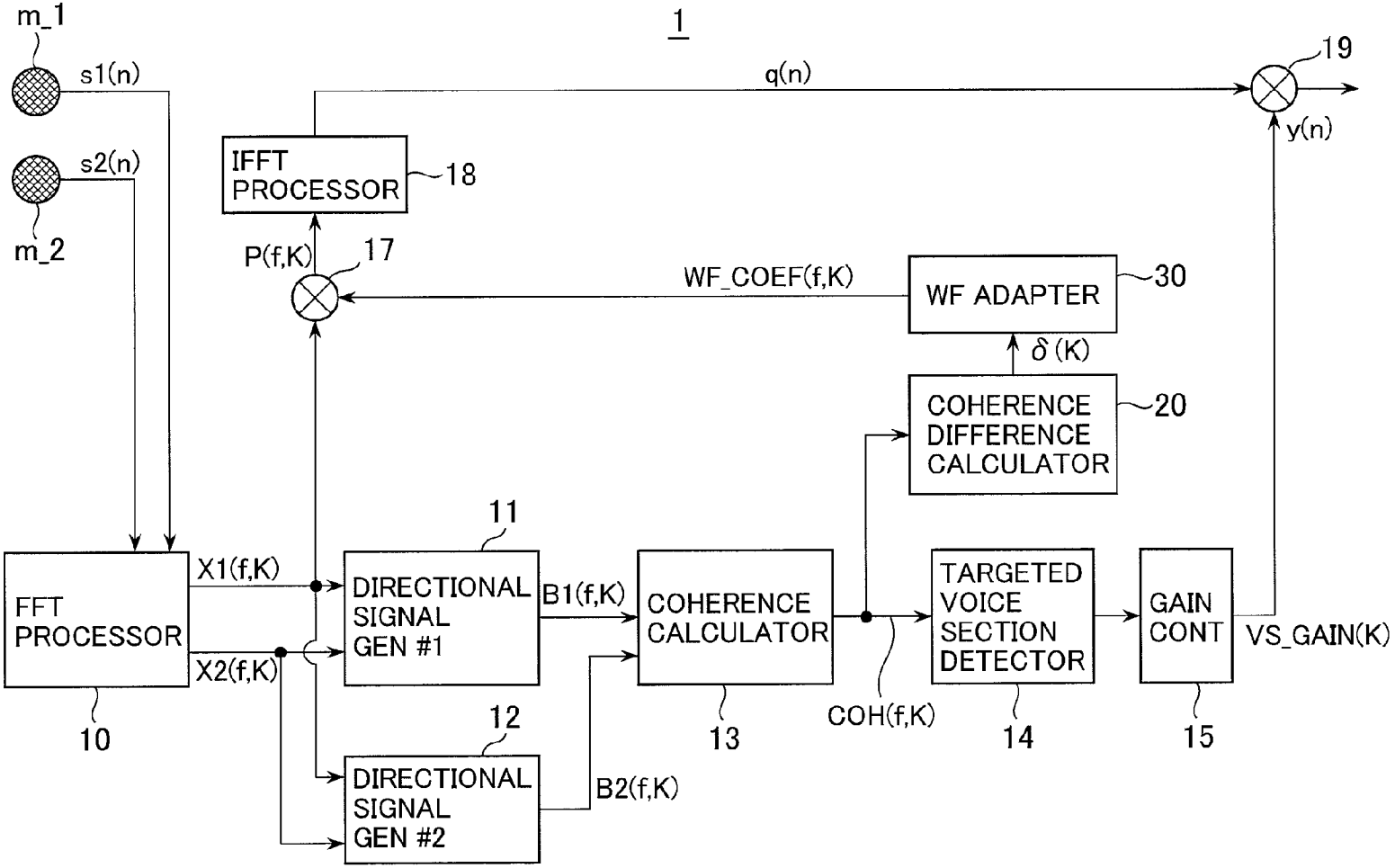
FIG. 1 is a schematic block diagram showing the configuration of a voice signal processor according to an illustrative embodiment of the present invention.
Figure 2:
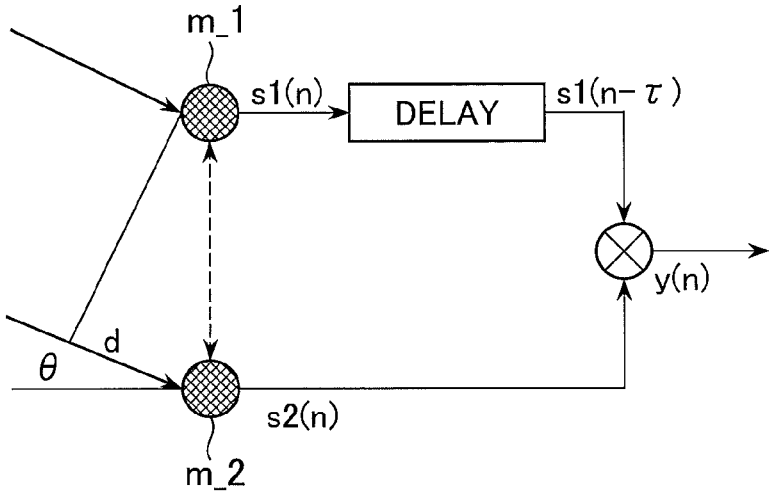
FIG. 2 is a schematic block diagram useful for understanding a difference in arrival time of two input signals arriving at microphones in a direction at an angle of θ.
Figure 3:
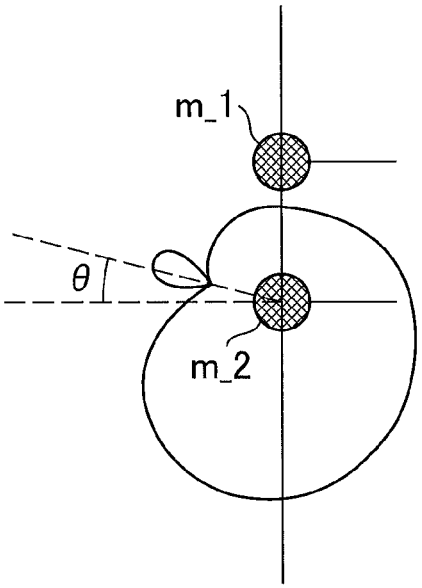
FIG. 3 shows a directivity pattern caused by a directional signal generator shown in FIG. 1.

Now, with reference to the accompanying drawings, referred embodiments in accordance with the present invention will be described below. Since the drawings are merely for illustration, the present invention is not to be restricted by what are specifically shown in the drawings.

FIG. 1 is a schematic block diagram showing the configuration of a voice signal processor, generally 1, in accordance with an illustrative embodiment of the present invention, where temporal sections optimal for a voice switch and a Wiener filter are detected only based on behaviors intrinsic to coherence without employing plural types of schemes for detecting voice sections and without extensively burdening the user of the system. Although the constituent elements expect a pair of microphones m_1 and m_2 may be implemented in place of, or addition to, hardware in the form of software to be stored in and run on a processor system including a central processing unit (CPU), they may be represented in the form of functional boxes as shown in FIG. 1.

In FIG. 1, the voice signal processor 1 according to the embodiment may be applied to, for example, a video conference or cellular phone system, particularly to its terminal set or handset. The voice signal processor 1 comprises microphones m_1 and m_2, a fast Fourier transform (FFT) processor 10, a first and a second directional signal generator 11 and 12, a coherence calculator 13, a targeted voice section detector 14, a gain controller 15, a Wiener filter (WF) adapter 30, a WF coefficient multiplier 17, an inverse fast Fourier transform (IFFT) processor 18, a voice switch (VS) gain multiplier 19, and a coherence difference calculator 20, which are interconnected as depicted.

The microphones m_1 and m_2 are adapted to stereophonically catch sound therearound to produce corresponding input signals s1($n$) and s2($n$) to the FFT processor 10, respectively, via analog-to-digital (A/D) converters, not shown. Note that the index n is a positive integer indicating the temporal order in which samples of sound signals are entered. In the present specification, a smaller n indicates an older sample and vice versa.

The FFT processor 10 is connected to receive strings of input signal s1 and s2 from the microphones m_1 and m_2, and subjects the strings of input signal s1 and s2 to a discrete Fourier transform, i.e. fast Fourier transform with the embodiment. Consequently, the input signals s1 and s2 will be represented in the frequency domain. Before applying the fast Fourier transform, analysis frames FRAME 1(K) and FRAME 2(K) are made from the input signals s1 and s2. Each of the frames is consisted of N samples, where N is a natural number. An example of FRAME 1 made from the input signal s1 can be represented as a set of input signals by the following expressions, where the index K is a positive integer indicating the order in which frames are arranged.

$$\text{FRAME } 1(1) = \{s1(1), s1(2), \ldots, s1(i), \ldots, s1(N)\}$$

$$\ldots$$

$$\ldots$$

$$\text{FRAME } 1(K) = \{s1(N\times K+1), s1(N\times K+2), \ldots, s1(N\times K+i), \ldots, s1(N\times K+N)\}$$

In the present specification, a smaller K indicates an older analysis frame and vice versa. In the following description of operation, it will be assumed that an index indicating the newest analysis frame to be analyzed is K unless otherwise stated.

In the FFT processor 10, each analysis frame is subjected to the fast Fourier transform. Thus, frequency-domain signals X1(f, K) and X2(f, K) obtained by subjecting the Fourier transform to the analysis frames FRAME1(K) and FRAME2(K), respectively, are supplied to the first and second directional signal generators 11 and 12, where an index f indicates frequency. Additionally, the signal X1(f, K) does not take a single value but is composed of spectral components of plural frequencies f1-fm as given by the following expression:

$$X1(f,K)=\{X1(f1,K), X1(f2,K) \ldots, X1(fi,K), \ldots, X1(fm,K)\}$$

Also, the signals X2(f, K) as well as B1(f, K) and B2(f, K) appearing in the rear stage of a directional signal generator are composed of spectral components of plural frequencies.

The first directional signal generator 11 functions as obtaining a signal B1(f, K) having its directivity specifically strongest in the rightward direction (R) defined by the following Expression (1):

$$B1(f) = X2(f) - X1(f)\times\exp\left[-\frac{i2\pi\ f\ S}{N}\tau\right] \tag{1}$$

where S is the sampling frequency, N is an FFT analysis frame length, τ is the difference in time between a couple of microphones when catching a sound wave, and i is the imaginary unit.

The second directional signal generator 12 functions as obtaining a signal B2(f, K) having its directivity strongest in the leftward direction (L) defined by the following Expression (2):

$$B2(f) = X1(f) - X2(f)\times\exp\left[-\frac{i2\pi\ f\ S}{N}\tau\right] \tag{2}$$

The signals B1(f, K) and B2(f, K) are represented in the form of complex numbers. Since the frame index K is independent of calculations, it is not included in the computational expressions.

With reference to FIGS. 2 to 5, it will be described how those expressions mean with the Expression (1) taken as an example. It is assumed that sound waves arrive from a direction at an angle of θ indicated in FIG. 2 with respect to a reference direction and are picked up by the pair of microphones m_1 and m_2 spaced apart by a distance of l from each other. In this case, there is a time difference between the instants at which the sound waves are captured by the microphones m_1 and m_2. Since the sound wave path difference d may be expressed by d=l×sin θ, the time difference τ is given by the following Expression (3), where c is the sound velocity.

$$\tau = l\times\sin\theta/c \tag{3}$$

When a signal s1($n$−τ) represents a signal caught by the microphone m_1 earlier by a period of time τ than the time at which the input signal s2($n$) is caught by the microphone m_2, the signal s1($n$−τ) and the input signal s2($n$) comprise the same sound component arriving from the direction at the angle of θ. Therefore, calculation of a difference between them will make it possible to obtain a signal which does not include the sound component in the direction at the angle of θ. The signal obtained by finding the difference between the signals of s2($n$) and s1($n$−τ) will now be referred to as a signal y(n), i.e. y(n)=s2($n$)−s1($n$−τ). As a result, the microphone array, m_1 and m_2, has its directivity pattern shown in FIG. 3, in this example.

Figure 4:
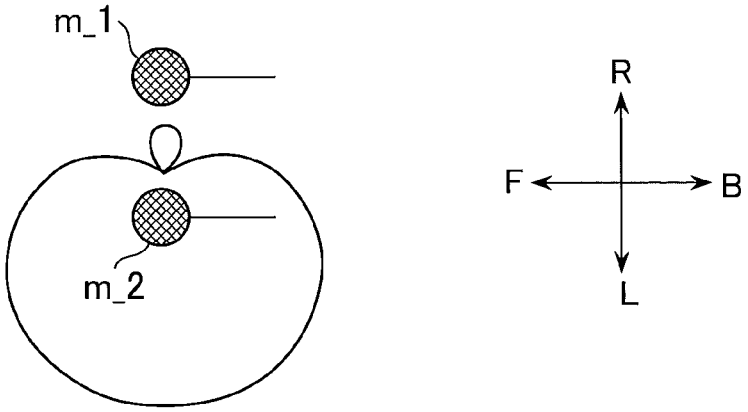
FIGS. 4 and 5 show directivity patterns exhibited by two directional signal generators shown in FIG. 1 when θ is equal to 90 degree.
Figure 5:
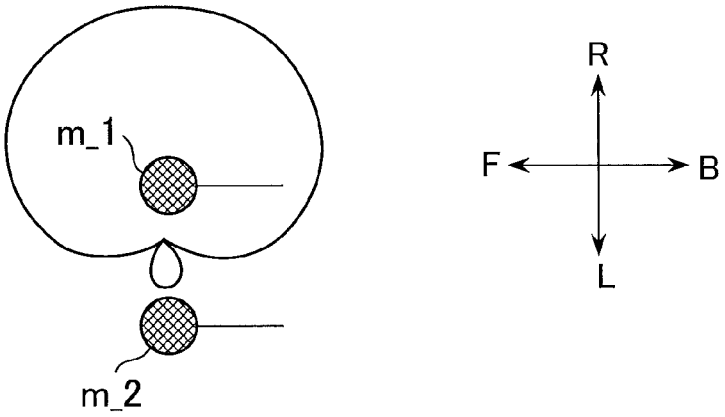

The description has been provided so far on calculations in the time domain. Similar calculations may be performed in the frequency domain. In the frequency domain calculation, the Expressions (1) and (2) are applied. As an example, it is assumed that angles θ of the directions in which signals arrive are ±90 degrees. Specifically, as shown in FIG. 4, the first directional signal generator 11 obtains the directivity signal B1(f, K) which has its directivity strongest in the rightward direction. Further, as shown in FIG. 5, the second directional signal generator 12 obtains the second directivity signal B2(f, K) which has its directivity strongest in the leftward direction.

The coherence calculator 13 is adapted to perform calculations according to the following Expressions (4) and (5) on the directivity signals B1(f, K) and B2(f, K) to thereby obtain coherence COH(K). In Expression (4), B2(f, K)* is a complex conjugate to B2(f, K). Since the frame index K is again not dependent upon calculations, the index does not appear in those expressions.

$$coef(f) = \frac{|B1(f)\cdot B2(f)^*|}{\frac{1}{2}\{|B1(f)|^2 + |B2(f)|^2\}} \tag{4}$$

-continued $$COH = \sum_{f=0}^{M-1} coef(f)/M \tag{5}$$

In the targeted voice section detector 14, the coherence COH (K) is compared with a targeted voice section decision threshold value Θ. If the coherence is greater than the threshold value Θ, it is determined that the temporal section is a targeted voice section. Otherwise, it is determined that the temporal section is an untargeted voice section.

Now, it will briefly be described why a targeted voice section is detected depending on the magnitude of coherence. The concept of coherence can be described as a correlation between a signal incoming from the right and a signal incoming from the left with respect to a microphone. Expression (4) is for use in calculating the correlation for a frequency component. Expression (5) is used to calculate the average of correlation values over the entire frequency components. Accordingly, when coherence COH is smaller, the correlation between the two directivity signals B1 and B2 is smaller. Conversely, when coherence COH is larger, the correlation is larger. When the input signals have the correlation thereof smallest, their directions of arrival are extreme right or left with respect to the microphone, or the input signals are small in periodicity as with noises even though the arrival directions are not in directions other than the front (F) of the microphone. Therefore, it can be said that a temporal section where the value of coherence COH of the input signals is smaller may be deemed as a disturbing voice or a background noise section, i.e. an untargeted voice section. By contrast, a temporal section where the value of coherence COH of the input signals is larger, the directions of arrival are not in directions other than the front, and hence it can be said that the input signals arrive from the front. Under those circumstances, since it is assumed that the targeted voice arrives from the front of the microphone, it can be said that the section where the coherence COH of the input signals is larger is a targeted voice section.

In a gain controller 15, if the temporal section is a targeted voice section, the gain VS_GAIN of the voice section is set to 1.0. If the temporal section is an untargeted voice section, the gain VS_GAIN is set to an arbitrary positive value cc less than 1.0.

The coherence difference calculator 20 calculates the difference δ(K) between an instantaneous value COH(K) of coherence in an untargeted voice section and the long-term average value AVE_COH (K) of coherence settled in the calculator 20. The WF adapter 30 of the embodiment is adapted for detecting background noise sections, and using the difference δ(K) and the instantaneous value COH(K) of the coherence to calculate a new Weiner filter coefficient to deliver the new WF_COEF(f, K) to the WF coefficient multiplier 17.

The background noise sections will be detected by means of the features of coherence, as will be described below. In a targeted voice section, coherence generally exhibits larger values, and targeted voice greatly fluctuates in amplitude, i.e. involves larger and smaller amplitude components. By contrast, in an untargeted voice section, the value is generally smaller and fluctuates only a little. Furthermore, even in the untargeted voice sections, coherence varies in a limited range. In a temporal section where the waveform such as disturbing voice includes a clear periodicity, such as pitch of speech, a correlation tends to appear and coherence is relatively larger. In a temporal section having its regularity smaller, coherence shows especially smaller values. It can be said that a temporal section having its periodicity smaller is a background noise section.

Figure 6:
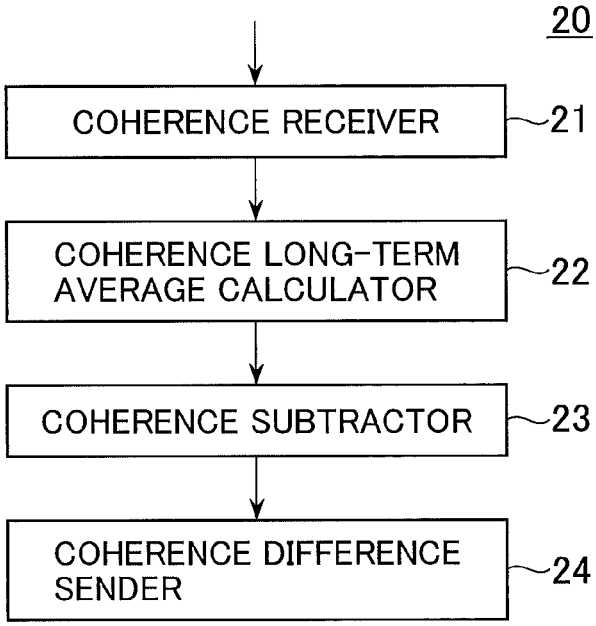
FIG. 6 is a schematic block diagram of a coherence difference calculator of the voice signal processor shown in FIG. 1.

FIG. 6 is a schematic block diagram particularly showing the configuration of the coherence difference calculator 20. As shown in the figure, the coherence difference calculator 20 has a coherence receiver 21, a coherence long-term average calculator 22, a coherence subtractor 23, and a coherence difference sender 24, which are interconnected as depicted.

The coherence receiver 21 is connected to receive the coherence COH(K) computed by the coherence calculator 13. The targeted voice section detector 14 is adapted for determining whether or not the coherence COH (K) of the currently processed subject, e.g. frame, belongs to an untargeted voice section.

The coherence long-term average value calculator 22 serves as updating, if the currently processed signal belongs to an untargeted voice section, the coherence long-term average AVE_COH (K) according to the following Expression (6):

$$\text{AVE_}COH(K)=\beta\times COH(K)+(1-\beta)\times \text{AVE_}COH(K-1) \tag{6}$$

where $0.0<\beta<1.0$. It is to be noted that the expression for calculating the coherence long-term average AVE_COH(K) is not restricted to the Expression (6). Rather, other calculation expressions such as simple averaging of a given number of sample values may be applied.

The coherence subtractor 23 serves to calculate the difference δ(K) between the coherence long-term average AVE_COH (K) and the coherence COH (K) according to the following Expression (7).

$$\delta(K)=\text{AVE_}COH(K)-COH(K) \tag{7}$$

The coherence difference sender 24 supplies the WF adapter 30 with the obtained difference δ(K).

Figure 7:
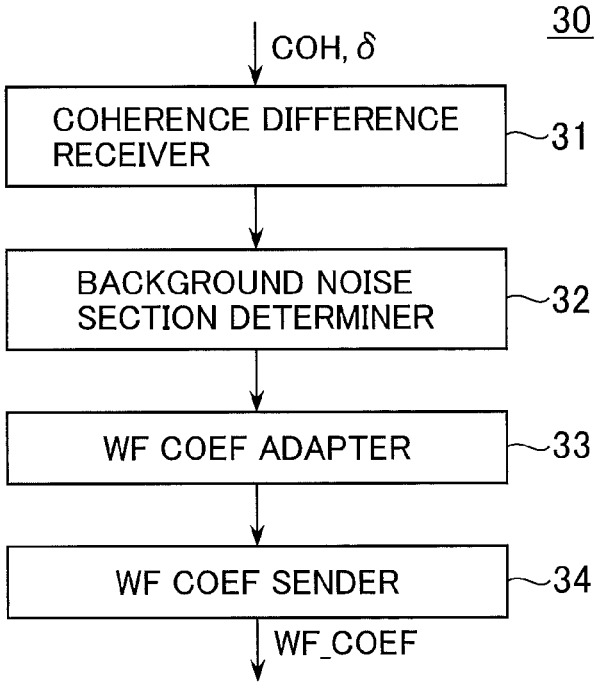
FIG. 7 is a schematic block diagram of a Wiener filter (WF) adapter of the voice signal processor shown in FIG. 1.

FIG. 7 is a schematic block diagram of the WF adapter 30 of the embodiment, particularly showing the configuration of the adapter 30. As seen from the figure, the WF adapter 30 has a coherence difference receiver 31, a background noise section determiner 32, a WF coefficient adapter 33, and a WF coefficient sender 34, which are interconnected as illustrated.

The coherence difference receiver 31 is connected to receive the coherence COH (K) and the coherence difference δ(K) from the coherence difference calculator 20.

The background noise section determiner 32 functions to determine whether or not a temporal section is a background noise section. If a background noise section has its coherence COH(K) smaller than a threshold value Θ for a targeted voice and the coherence difference δ(K) is smaller than a threshold value Φ(Φ<0.0) for a coherence difference, then the background noise section determiner 32 determines the temporal section of interest is a background noise section.

If the result of the determination made by the background noise section determiner 32 is that the temporal section under determination is a background noise section, the WF coefficient adapter 33 then obtains the characteristic of background noise based on the signals in this section determined as a noise section and calculates a new Wiener filter coefficient. Otherwise, the adapter 33 does not obtain a new Wiener filter coefficient. The adapter 33 may obtain the characteristic of the background noise according to a well-known method as disclosed in Klein described earlier.

The WF coefficient sender 34 supplies the WF coefficient multiplier 17 with the new Wiener filter coefficient obtained by the WF coefficient adapter 33. In the following, the operation performed by the adapter 30 may be referred to as "adaptation operation."

When the WF coefficient multiplier 17 receives the Wiener filter coefficient WF_COEF(f, K) from the WF adapter 30, it updates the Wiener filter coefficient set in the multiplier 17. In the WF coefficient multiplier 17, the FFT-transformed signal X1(f, K) of the input signal string s1(*n*) is multiplied by the coefficient defined by the following Expression (8). Consequently, obtained is a signal P(f, K) that is an input signal whose background noise characteristics have been suppressed.

$$P(f,K)=X1(f,K)\times WF_COEF(f,K) \quad (8)$$

The IFFT processor 18 converts the background noise suppressed signal P(f, K) to a corresponding time-domain signal string q(n), and then the VS gain multiplier multiplies the signal string q(n) by the gain VS_GAIN (K) set by the gain controller and defined by the following Expression (9). As a result, an output signal y(n) is obtained.

$$y(n)=q(n)\times VS_\mathrm{GAIN}(K) \quad (9)$$

Since the background noise characteristic is thus obtained from the signals in the background noise section and the noise characteristic is used to calculate the Wiener filter coefficient, the Wiener filter coefficient is not reflected by the characteristic of disturbing voice, and thus, deterioration of the targeted voice can be prevented.

Figure 8:
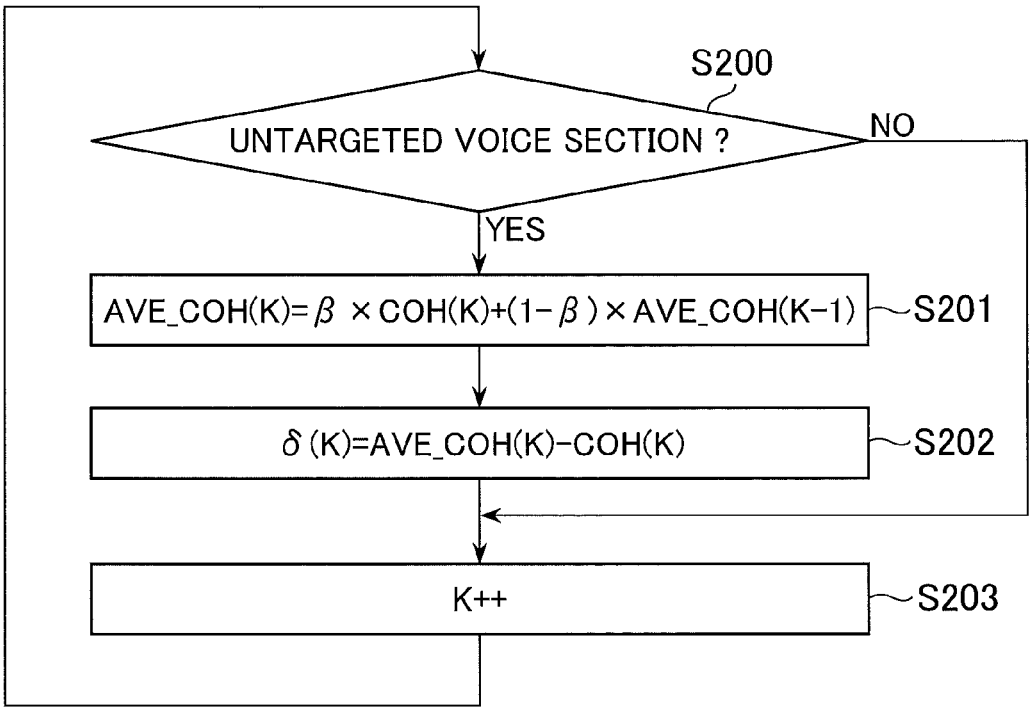
FIG. 8 is a flowchart useful for understanding the operation of the coherence difference calculator of the voice signal processor shown in FIG. 1.
Figure 9:
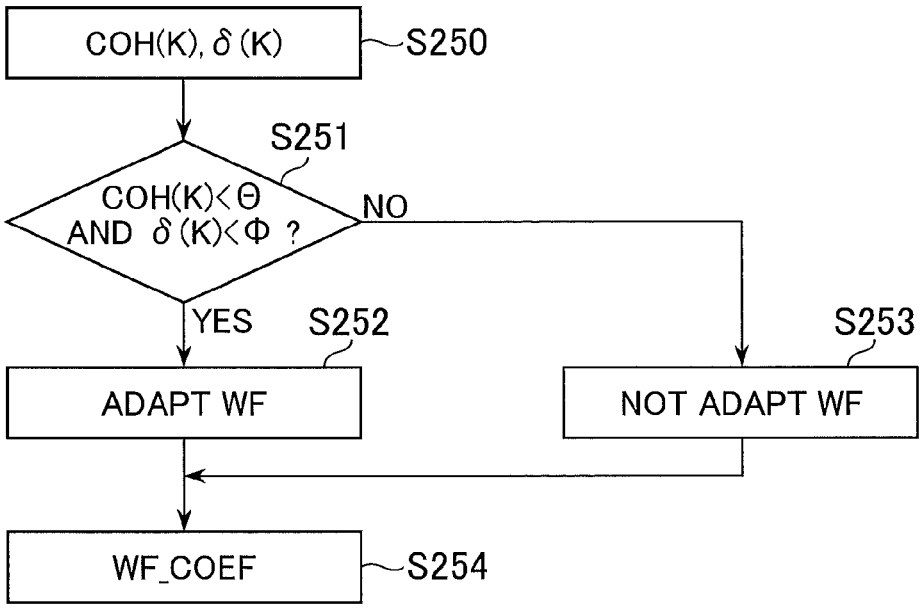
FIG. 9 is a flowchart useful for understanding the operation of the WF adapter of the voice signal processor shown in FIG. 1.

The operation of the voice signal processor 1 of the embodiment will next be described with further reference to FIGS. 8 and 9. The general operation, and detailed operation of the coherence difference calculator 20 and the WF adapter 30 will be described in turn.

Signals produced from the pair of microphones m_1 and m_2 are transformed from the time domain into frequency-domain signals X1(f, K) and X2(f, K) by the FFT processor 10. From the signals X1(f, K) and X2(f, K), directivity signals B1(f, K) and B2(f, K) that have null in certain azimuthal directions, or blind directions, are produced by the first and second directional signal generators 11 and 12, respectively. The signals B1(f, K) and B2(f, K) are used to calculate the coherence COH(K) by means of Expressions (4) and (5).

The targeted voice section detector 14 makes a decision on whether or not the temporal section the signals s1(*n*) and s2(*n*) belong to is a targeted voice section. Based on the result of the decision made in the detector 14, the gain VS_GAIN(K) is set in the gain controller 15.

The coherence difference calculator 20 calculates the difference δ(K) between the instantaneous value COH (K) of the coherence in an untargeted voice section and the long-term average value AVE_COH(K) of the coherence. In the WF adapter 30, the coherence COH(K) and the difference δ(K) are used to detect background noise sections. Then a noise characteristic is newly obtained from the background noise section to calculate a Wiener filter coefficient to send the latter to the WF coefficient multiplier 17 so as to update the Wiener filter coefficient set in the multiplier 17. In the WF coefficient multiplier 17, the input signal X1(f, K) in the frequency domain is multiplied by the Wiener filter coefficient WF_COEF(f, K). The resultant signal P(f, K), namely, the signal P(f, K) suppressed by a Wiener filter technique, is converted to a time-domain signal string q(n) by the IFFT processor 18. In the VS gain multiplier 19, this signal q(n) is multiplied by the gain VS_GAIN (K) set by the gain controller 15, thus producing a resultant output signal y(n).

The operation of the coherence difference calculator 20 will be described. FIG. 8 is a flowchart for use in understanding the operation of the coherence difference calculator 20.

When the coherence receiver 21 receives the coherence COH(K), the receiver 21 references the targeted voice section detector 14 to determine whether or not the subject signal belongs to an untargeted voice section (step S200). If the subject signal is determined as an untargeted voice section, then the coherence long-term average calculator 22 updates the coherence long-term average AVE_COH(K) according to Expression (6) (step S201). Thence, the coherence subtractor 23 subtracts the coherence COH(K) from the coherence long-term average AVE_COH(K) according to Expression (7) to thereby obtain the difference δ(K) (step S202). The obtained coherence difference δ(K) is fed from the coherence difference sender 24 to the WF adapter 30. The subject to be processed is in turn updated (step S203) to repetitively proceed to the processing operations described so far.

The operation of the WF adapter 30 will be described with reference to FIG. 9, which is a flowchart useful for understanding the operation of the WF adapter 30.

When the coherence difference receiver 31 receives the coherence COH (K) and the coherence difference δ(K) in step S250, the background noise section detector 32 determines whether or not the coherence COH(K) is substantially smaller than the threshold value Θ and the coherence difference δ(K) is smaller than the threshold value Φ(<0.0), in other words, whether or not the temporal section to which the subject signal belongs is a background noise section (step S251). If it is determined as a background noise section, the WF coefficient adapter 33 obtains a noise characteristic from the signals in this noise section to calculate a new Wiener filter coefficient (step S252). Otherwise, the adapter 33 does not obtain a new Wiener filter coefficient (step S253). The new Wiener filter coefficient WF_COEF(f, K) is supplied from the WF coefficient sender 34 to the WF coefficient multiplier 17 so as to update the Wiener filter coefficient set in the multiplier 17 (step S254).

In summary, according to the illustrative embodiment, the feature that coherence is smaller especially in background noise sections is utilized to detect sections purely including background noise among untargeted voice sections, and only the feature of the background noise is used for calculation of the Wiener filter coefficient. Signal sections adapted for the voice switch and the Wiener filter can thus be detected using a single parameter, i.e. coherence, thus making it possible to properly use both of the voice switch and the Wiener filter. The problem raised in the prior art that targeted voice was distorted by a Wiener filter coefficient on which the characteristics of disturbing voice are reflected can be overcome. Furthermore, optimum sections can be detected without introducing multiple voice section detecting schemes. Hence, the amount of calculation can be prevented from increasing. It is not necessary to adjust plural parameters of different characteristics. The burden on the user of the system can be prevented from increasing.

A telecommunications device or system such as a video conference system or cellular phone system comprised of the voice signal processor of the illustrative embodiment may advantageously be improved in the quality of telephone communications.

Next, an alternative embodiment of the present invention will be described by referring further to FIGS. 10 and 11. The embodiment shown in FIG. 1 is adapted to discriminate the background noise sections from the untargeted voice sections to estimate the Wiener filter coefficient. Thus, the coefficient can accurately be estimated. However, the coefficient may be estimated less frequently. This would take a long time until sufficient noise suppressing performance is attained so as to render the user of the system exposed to the unfavorable circumstances of sound quality.

Figure 10:
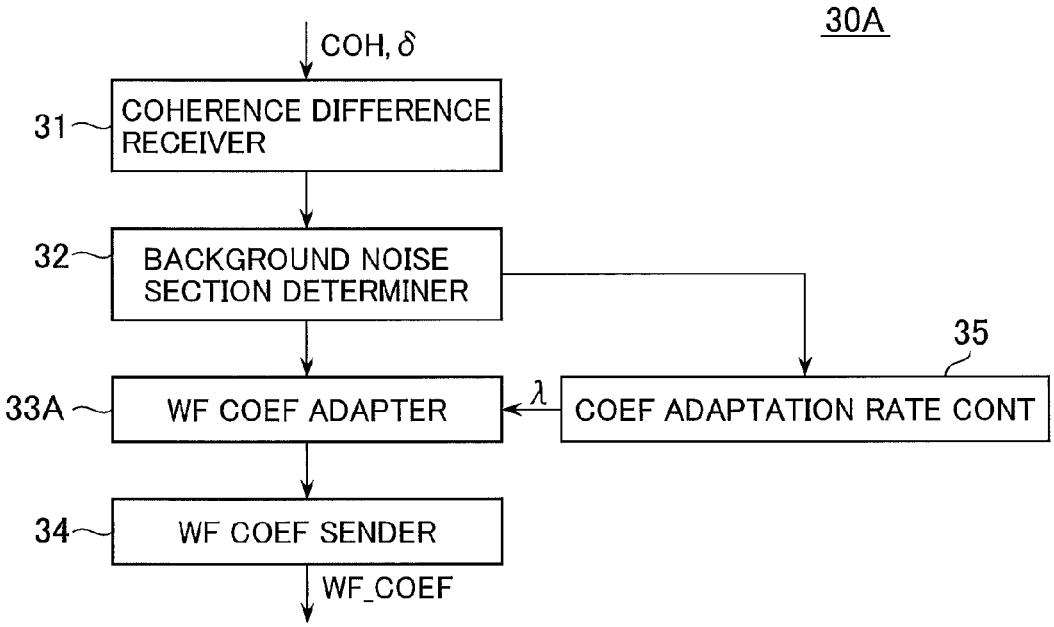
FIG. 10 is a schematic block diagram showing the configuration of a WF adapter according to an alternative embodiment of the present invention.

The WF adapter according to the alternative embodiment comprises a coefficient adaptation rate controller 38, FIG. 10. The reflection of characteristics of background noise on the Wiener filter coefficient is changeable in such a fashion that immediately after the start of adaptive operation the characteristic of the instantaneous background noise will immediately be reflected on the coefficient and thereafter its reflection on the coefficient will be reduced.

The voice signal processor according to this alternative embodiment may be similar to the voice signal processor 1 according to the illustrative embodiment shown in and described with reference to FIG. 1 except for the details of configuration and operation of the WF adapter 30A, FIG. 10. Therefore, only the WF adapter 30A of the alternative embodiment will be described.

FIG. 10 is a schematic block diagram of the WF adapter 30A of this alternative embodiment, particularly showing the configuration of the adaptation portion 30A. As shown in the figure, the WF adapter 30A has a coefficient adaptation rate controller 35 in addition to the coherence difference receiver 31, background noise section detector 32, WF coefficient adapter 33A and WF coefficient sender 34, which are interconnected as depicted. Like components or elements are designated with the same reference numerals, and a repetitive description thereon will be avoided.

The coefficient adaptation rate controller 35 is adapted to count the number of temporal sections determined as background noise sections and sets the value of a parameter λ that is used to control to which extent the noise characteristics of the subject background noise section reflects on the Wiener filter coefficient according to whether or not the obtained count is substantially smaller than a predetermined threshold value.

If the result of the determination made by the background noise section detector 32 is that the temporal section under determination is not a background noise section, then the WF coefficient adapter 33A will not calculate a new Wiener filter coefficient and the signal X1(f, K) will be multiplied with the Wiener filter coefficient obtained from the signals in the preceding background noise section. If the result of the determination made by the background noise section detector 32 is that the temporal section under determination is a background noise section, then the adapter 33A will make use of the parameter λ received from the coefficient adaptation rate controller 35 to estimate in computation a new Wiener filter coefficient.

The role of the parameter λ will now briefly be described. A Wiener filter coefficient may be obtained by a calculation according to the expression disclosed in Klein.

Prior to this calculation, background noise characteristics have to be calculated for each frequency. Background noise may be estimated using the expression disclosed in Klein. The parameter λ assumes values from 0.0 to 1.0, inclusive, and acts to control how much the instantaneous input value is reflected on the background noise characteristic.

As the parameter λ is increased, the effect of the instantaneous input becomes more intensive. Conversely, as the parameter decreases, the effect of the instantaneous input becomes less intensive. Accordingly, when the parameter λ is larger, the instantaneous input is more strongly reflected on the Wiener filter coefficient, and it is thus possible to promptly adapt the Wiener filter coefficient to the background noise. However, since the effect of the instantaneous input is strong, the coefficient value remarkably varies so as to deteriorate the naturalness of sound quality. Conversely, when the parameter λ is smaller, the prompt reflection of the instantaneous input cannot be achieved but the obtained coefficient is not greatly affected by the instantaneous characteristics, and past noise characteristics are reflected averagely. Thus, the coefficient does not vary greatly so that the naturalness of sound quality may be maintained.

Since the parameter λ behaves as described so far, high-speed erasing performance can be accomplished by setting larger the parameter λ immediately after the start of the adaptive operation. After some period of time has lapsed, the parameter λ is set smaller. As a result, natural sound quality can be accomplished. The operation of the WF adapter 30A of the instant embodiment has briefly been described thus far.

The operation of the coefficient adaptation controller 35 will be described with reference to the flowchart shown in FIG. 11.

First, based on the result of the decision made by the background noise section detector 32, the coefficient adaptation controller 35 makes a decision on whether or not the temporal section being checked is a background noise section (step S300). If the decision reveals the temporal section is a background noise section, then the counter value is incremented by one n(K) in order to determine whether or not the background noise section occurred immediately after the start of the adaptation operation (step S301). Otherwise, the counter value n(K) is not incremented. Then, the counter value n(K) is compared with a threshold value T, where T is a positive integer, for an initial adaptation time to make a determination on whether or not the background noise section occurred immediately after the start of the adaptation operation. If the counter value n(K) is less than the threshold value T, it is determined that the background noise section occurred immediately after the start of the adaptation operation for the Wiener filter coefficient. If the value is equal to or greater than the threshold value T, it is determined that the background noise section did not occur immediately after the start of the adaptation operation (step S302). If the background noise section is determined as one having occurred immediately after the start of the adaptation operation, then the parameter λ is set to a larger value in order to reflect the noise characteristic of the subject background noise on the Wiener filter coefficient promptly (step S303). If that is not the case, the parameter λ is set to a smaller value to suppress the reflection of the noise characteristic of the subject background noise (step S304).

According to the alternative embodiment, immediately after the start of the adaptation operation, the Wiener filter coefficient is quickly adapted to background noise so that high-speed noise suppression may be accomplished. Furthermore, after a lapse of some period of time, the influence of background noise at the time on the Wiener filter coefficient is reduced, so that excessive adaptation to instantaneous noises can be prevented. Thus, natural sound quality may be maintained.

Improvement may thus be expected on the sound quality of telephone communications in a telecommunications system or device such as a video conference system or cellular phone system exploiting the voice signal processor of the instant alternative embodiment.

Next, another alternative embodiment of voice signal processor according to the present invention will be described with reference to FIG. 12. A voice signal processor 1B according to the present alternative embodiment may be similar in configuration to the embodiment shown in FIG. 1 except that a coherence filter configuration is added.

A coherence filter is adapted to multiply an input signal X1(f, K) by an obtained coherence "coef(f, K)" so as to suppress components of the signal incoming not from the front but from the left or right with respect to the microphone.

Figure 12:
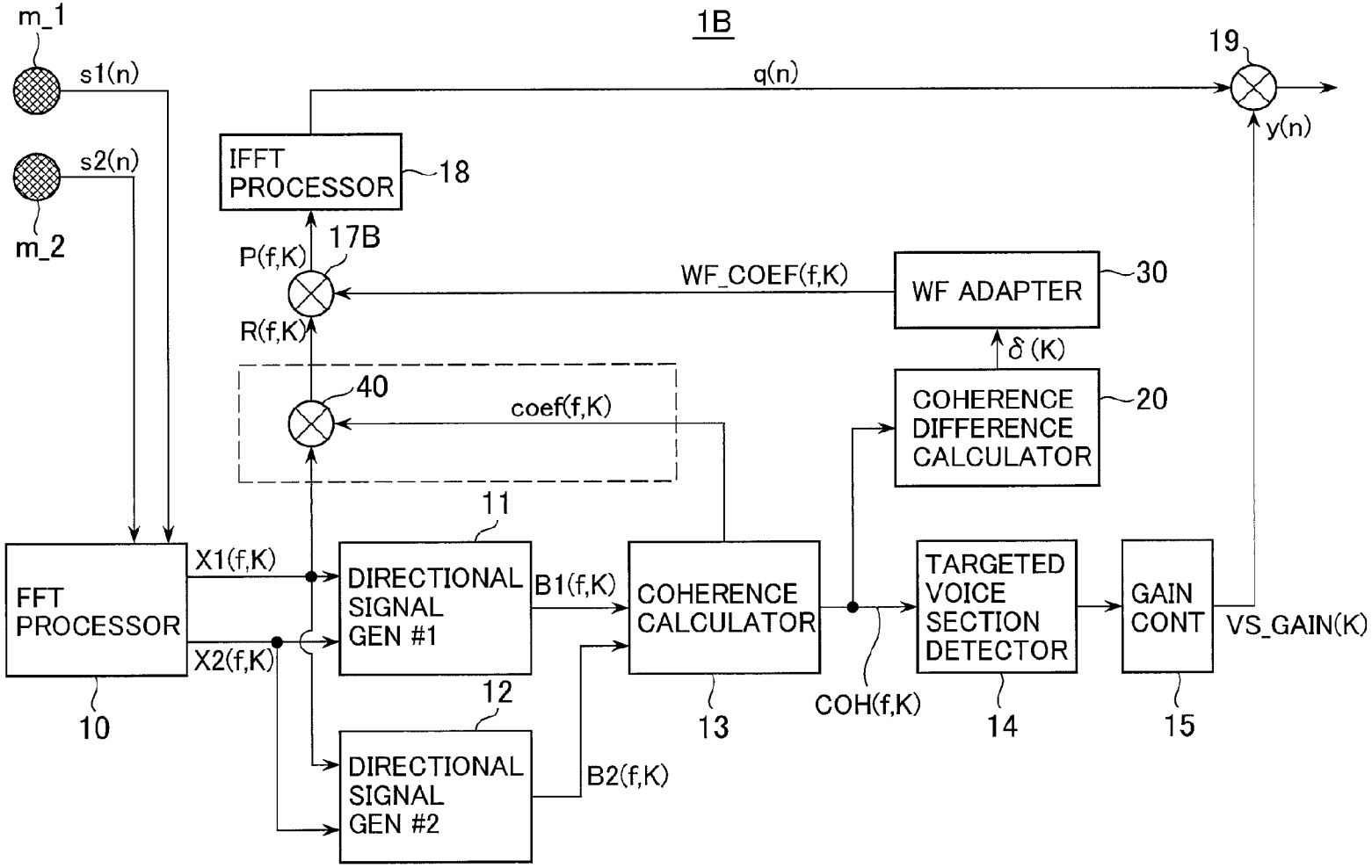
FIGS. 12 and 13 are schematic block diagrams showing the configuration of voice signal processors according to other alternative embodiments of the present invention.

FIG. 12 is a schematic block diagram showing the configuration of the voice signal processor 1B associated with this alternative embodiment. Again, like components or elements are designated with the same reference numerals.

In FIG. 12, the voice signal processor 1B according to this alternative embodiment may be similar in configuration to that of the embodiment shown in FIG. 1 except that a coherence filter coefficient multiplier 40 is added and that the WF coefficient multiplier 173 is slightly modified in operation.

The coherence filter coefficient multiplier 40 has its one input port supplied with coherence "coef(f, K)" from the coherence calculator 13. The multiplier 40 also has its other input port supplied with an input signal X1(f, K) converted in the frequency domain from the FFT processor 10. The multiplier 40 multiplies both of them with each other by means of the following Expression (10) to thereby obtain a coherence-filtered signal R0(f, K).

$$R0(f,K)=X1(f,K)\times coef(f,K) \tag{10}$$

The WF coefficient multiplier 17B of this embodiment multiplies the coherence-filtered signal R0(f, K) by the Wiener filter coefficient WF_COEF(f, K) from the WF adapter 30 as given by the following Expression (11), thus obtaining a Wiener-filtered signal P(f, K).

$$P(f,K)=R0(f,K)\times WF_COEF(f,K) \tag{11}$$

The subsequent processing performed by the IFFT processor 18 and VS gain multiplier 19 may be the same as the embodiment shown in FIG. 1.

The present alternative embodiment has the coherence filtering function thus added. That makes higher noise suppressing performance attained than that of the embodiment shown in and described with reference to FIG. 1.

Another alternative embodiment of voice signal processor according to the present invention will be described with reference to FIGS. 13 and 14. The voice signal processor 10 according to this alternative embodiment may be similar in configuration to the embodiment shown in FIG. 1 except that a frequency reduction is added to reduce noise by subtracting a noise signal from an input signal.

Figure 13:
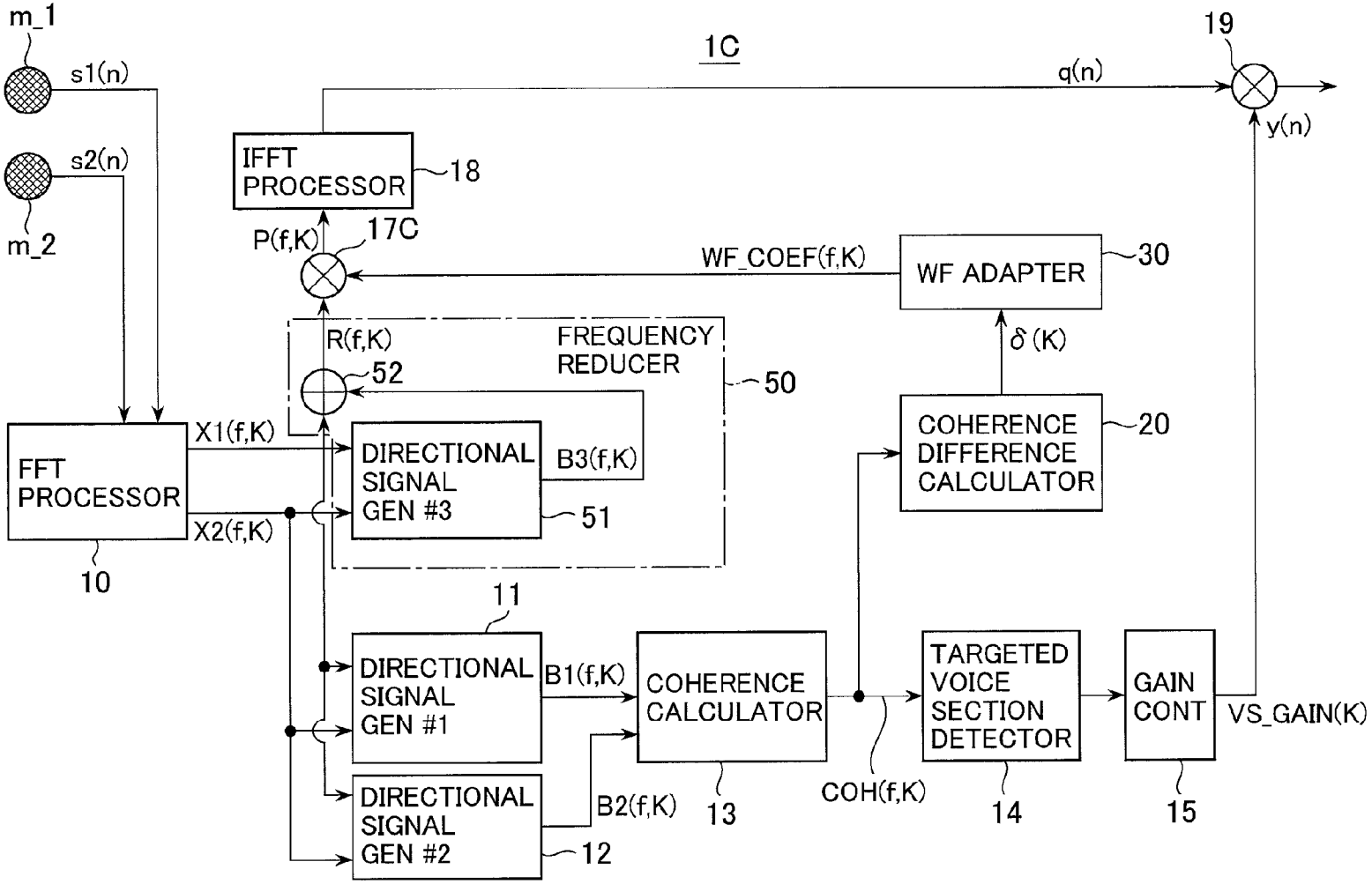
Figure 14:
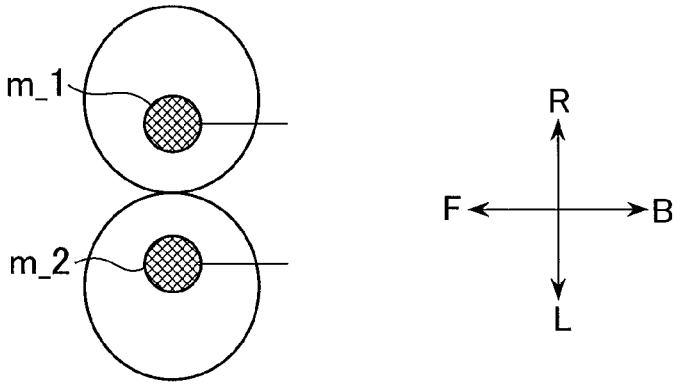
FIG. 14 shows a directivity pattern caused by a third directional signal generator shown in FIG. 13.

FIG. 13 is a schematic block diagram showing the configuration of the voice signal processor 10 associated with this alternative embodiment. Again, like components and elements are designated with the same reference numerals.

With reference to FIG. 13, the voice signal processor associated with this embodiment may be similar in configuration to the embodiment shown in FIG. 1 except that a frequency reducer 50 is added and that the WF coefficient multiplier 17C is slightly modified in operation. The frequency reducer 50 has a third directional signal generator 51 and a subtractor 52, which are interconnected as illustrated.

The third directional signal generator 51 is connected to be supplied with two input signals X1(f, K) and X2(f, K) transformed in the frequency domain from the FFT processor 10. The third directional signal generator 51 is adapted to form a third directivity signal B3(f, K) complying with a directivity pattern that is null in the front as shown in FIG. 14. The third directivity signal B3(f, K), i.e. noise signal, is in turn connected to one input, or subtrahend input, of the subtractor 52, which has its other input, or minuend input, connected to receive an input signal X1(f, K) transformed in the frequency domain. The subtractor 52 is adapted to subtract the third directivity signal B3(f, K) from the input signal X1(f, K) according to the following Expression (12) to thereby obtain a frequency-reduced signal R1(f, K).

$$R1(f,K)=X1(f,K)-B3(f,K) \tag{12}$$

The WF coefficient multiplier 170 of this alternative embodiment multiplies the frequency-reduced signal R1(f, K) by the Wiener filter coefficient WF_COEF(f, K) fed from the WF adapter 30 according to the following Expression (13) to thereby obtain a Wiener filtered signal P(f, K).

$$P(f,K)=R1(f,K)\times WF_COEF(f,K) \tag{13}$$

The subsequent processing performed by the IFFT processor 18 and VS gain multiplier 19 may be the same as the illustrative embodiment shown in FIG. 1.

According to the current alternative embodiment shown in FIG. 13, the frequency reducing function is added, thus accomplishing higher noise suppression.

The present invention may not be restricted to the above illustrative embodiments. Rather, modified embodiments as exemplified below are also possible.

As can be seen from the description of the above embodiments, two kinds of noise suppressing schemes, i.e. a voice switch and a Wiener filter, are used in the above embodiments. The above-described embodiments are specifically featured by extracting temporal sections consisting only of background noise based on the coherence. This feature especially contributes to improvement of the Wiener filter performance. Accordingly, the invention may also be applied to a voice signal processor introducing only a Wiener filter as a noise suppressing scheme. One example of a voice signal processor having only a Wiener filter as a noise suppressing scheme may be designed by eliminating the gain controller 15 and the VS gain multiplier 19 from the configuration shown in FIG. 1.

In the above-described embodiments, temporal sections consisting only of background noise among determined untargeted voice sections are detected based on the difference δ(K) between the instantaneous value COH (K) of the coherence and the long-term average value AVE_COH (K) of the coherence. Temporal sections consisting only of background noise may also be detected according to the magnitude of the variance or standard deviation of the coherence. The variance of the coherence indicates the deviation of instantaneous values COH(K) of the coherence from the average value of a given number of the newest instantaneous values of the coherence, and thus can be a parameter indicating the behavior of the coherence in the same way as the coherence difference.

The coherence filter shown in FIG. 12 and the frequency reducer shown in FIG. 13 may both be added to the embodiment shown in FIG. 1.

Still alternatively, at least either of the coherence filter and the frequency reducer may be added to the configuration of the embodiment shown in and described with reference to FIGS. 10 and 11.

Figure 11:
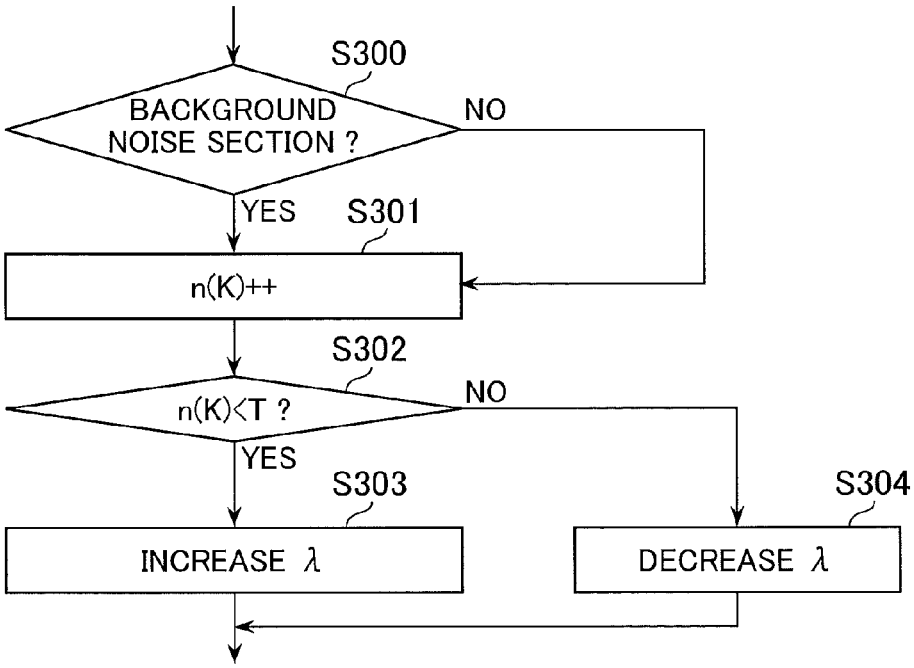
FIG. 11 is a flowchart useful for understanding the operation of a coefficient adaptation control portion of the WF adapter shown in FIG. 10.

In the embodiment shown in FIGS. 10 and 11, the adaptation rate is switched between two levels according to the value of the parameter λ. By setting plural threshold values, the influence of instantaneous background noise on the Wiener filter coefficient may be adjusted at three or more levels according to the values of the parameter λ corresponding to the threshold values.

Regarding the targeted voice section detector, the WF adapter in the above-described embodiments makes a decision based on coherence on whether or not the temporal section of interest is a targeted voice section. Alternatively, the decision may be made on another component on behalf of the WF adapter so that the WF adapter can only utilize the result of the detection. The term "targeted voice section detector", particularly set forth in the following claims, may be comprehended as any component which makes a decision based on coherence on whether or not the temporal section is a targeted voice section. Thus, when the WF adapter is adapted to make the decision, the targeted voice section detector in the claims may be comprehended as the WF adapter. When the WF adapter only utilizes the result of the detection made by an external, targeted voice section detector, this external detector may be comprehended as the targeted voice section detector.

In the above-described embodiments, the voice switch processing is performed after having performed the Wiener filter processing. These two types of processing may be reversed in order.

In the above illustrative embodiments, the input signals in the time domain may be transformed into the signals in the frequency domain to be processed. If desired, a system may be adapted to process signals in the time domain. Conversely, processing of signals in the time domain may be replaced by processing of signals in the frequency domain.

The above-described illustrative embodiments are adapted to a voice signal processor that processes signals immediately when picked up by a pair of microphones. Sound signals to be processed in accordance with the present invention may not be restricted to this type of signal. For instance, the voice signal processor may be adapted to process a pair of stereophonic sound signals read out from a recording medium. Further, the processor may be adapted to process a pair of sound signals sent from opposite devices.

The entire disclosure of Japanese patent application No. 2011-198728 filed on Sep. 12, 2011, including the specification, claims, accompanying drawings and abstract of the disclosure is incorporated herein by reference in its entirety.

While the present invention has been described with reference to the particular illustrative embodiments, it is not to be restricted by the embodiments. It is to be appreciated that those skilled in the art can change or modify the embodiments without departing from the scope and spirit of the present invention.

What is claimed is:

1. An apparatus for suppressing a noise component of an input voice signal, comprising:

a hardware computing device; and a storage medium having program instructions stored thereon, execution of which by the hardware computing device causes the apparatus to provide functions of:

a first directivity signal generator forming a first directivity signal having a directivity pattern substantially being null in a first direction, using first and second input signals that correspond to a plurality of signals in a temporal section;

a second directivity signal generator forming a second directivity signal having a directivity pattern substantially being null in a second direction, using the first and second input signals that correspond to the plurality of signals in the temporal section;

a coherence calculator using the first and second directivity signals to obtain a coherence value;

a targeted voice section detector determining, based on the coherence value, whether the temporal section is a targeted voice section, in which the plurality of signals arrive from a targeted direction, or an untargeted voice section, in which the plurality of signals arrive from an untargeted direction different from the targeted direction;

a coherence behavior calculator maintaining an average of all coherence values determined to correspond to the untargeted voice section, and upon detecting that an instantaneous coherence value obtained by the coherence calculator corresponds to the untargeted voice section, obtaining a difference between the instantaneous coherence value and the average;

a Wiener filter (WF) adapter comparing the difference obtained in said coherence behavior calculator with a predetermined threshold, and upon detecting that the difference is smaller than the threshold, determining that the temporal section is a background noise section that substantially contains no voice signal, and using signal characteristics of the signals in the background noise section to update a WF coefficient; and a WF coefficient multiplier multiplying the first input signal by the WF coefficient from the WF adapter.

2. The apparatus in accordance with claim 1, wherein said coherence behavior calculator calculates the difference between a newest instantaneous coherence value corresponding to the untargeted voice section and an average value of the coherence values calculated using previous input signals to obtain the difference.

3. The apparatus in accordance with claim 1, wherein said coherence behavior calculator calculates a variance value found from a predetermined number of newest instantaneous ones of the coherence values to form the difference.

4. The apparatus in accordance with claim 1, wherein said WF adapter makes a decision on whether or not the background noise section is detected immediately after start of detection of the background noise section to update the WF coefficient.

5. The apparatus in accordance with claim 1, further comprising a voice switch processor multiplying each of the plurality of signals in a stage of processing by a gain having a value dependent upon whether the temporal section is a targeted voice section or an untargeted voice section to thereby suppress noise.

6. The apparatus in accordance with claim 1, further comprising a coherence filter having a filter characteristic set to the coherence value obtained by said coherence calculator and multiplying the first input signal in a stage of processing by the coherence value to suppress a component of the first input signal in the untargeted direction.

7. The apparatus in accordance with claim 1, further comprising:

a frequency reducer comprising a third directivity signal generator producing a third directivity signal having a directivity pattern substantially being null in a third direction; and a subtractor subtracting the third directivity signal from the first input signal in a stage of processing.

8. The apparatus of claim 1, wherein the coherence calculator calculates the coherence value using $$COH = \sum_{f=0}^{M-1} coef(f)/M,$$

COH is the coherence value, $$coef(f) = \frac{|B_1(f) \cdot B_2(f)^*|}{\frac{1}{2}\{|B_1(f)|^2 + |B_2(f)|^2\}},$$

$B_1(f)$ and $B_2(f)$ are respectively the first and second input signals, $B_2(f)^*$ is a complex conjugate of $B_2(f)$, and M is a maximum of frequency f.

9. A method for suppressing a noise component of an input voice signal by a voice signal processor, the voice signal processor including a hardware computing device, and a storage medium having program instructions stored thereon, execution of which by the hardware computing device causes the voice signal processor to provide functions of a signal generator, a coherence calculator, a targeted voice section detector, a coherence behavior calculator, a Wiener filter (WF) adapter and a WF coefficient multiplier, said method comprising:

forming, by the hardware computing device via the function of the signal generator, a first directivity signal having a directivity pattern substantially being null in a first direction, using first and second input signals that correspond to a plurality of signals in a temporal section;

forming, by the hardware computing device via the function of the signal generator a second directivity signal having a directivity pattern substantially being null in a second direction, using the first and second input signals that correspond to the plurality of signals in the temporal section;

using the first and second directivity signals by the hardware computing device via the function of the coherence calculator to calculate a coherence value;

determining, by the hardware computing device via the function of the target voice section detector, based on the coherence value, whether the temporal section is a targeted voice section, in which the plurality of signals arrive from a targeted direction, or an untargeted voice section, in which the plurality of signals arrive from an untargeted direction;

maintaining an average of all coherence values determined to correspond to the untargeted voice section, and upon detecting that an instantaneous coherence value calculated by the coherence calculator corresponds to the untargeted voice section, obtaining a difference between the instantaneous coherence value and the average by the hardware computing device via the function of the coherence behavior calculator;

comparing, by the hardware computing device via the function of the WF adapter, the difference with a predetermined threshold, and upon detecting that the difference is smaller than the threshold, determining that the temporal section is a background noise section that substantially contains no voice signal, and using signal characteristics of the signals in the background noise section to calculate a new WF coefficient;

updating a WF coefficient when the new WF coefficient is obtained; and multiplying the first input signal by the WF coefficient by the hardware computing device via the function of the WF coefficient multiplier.

10. The method of claim 9, wherein the coherence value is calculated using $$COH = \sum_{f=0}^{M-1} coef(f)/M,$$

COH is the coherence value, $$coef(f) = \frac{|B_1(f) \cdot B_2(f)^*|}{\frac{1}{2}\{|B_1(f)|^2 + |B_2(f)|^2\}},$$

$B_1(f)$ and $B_2(f)$ are respectively the first and second input signals, $B_2(f)^*$ is a complex conjugate of $B_2(f)$, and M is a maximum of frequency f.

11. A non-transitory computer-readable medium on which is stored a program for having a computer operate as a voice signal processor, wherein said program, when running on the computer, controls the computer to function as:

a first directivity signal generator forming a first directivity signal having a directivity pattern substantially being null in a first direction, using first and second input signals that correspond to a plurality of signals in a temporal section;

a second directivity signal generator forming a second directivity signal having a directivity pattern substantially being null in a second direction, using the first and second input signals that correspond to the plurality of signals in the temporal section;

a coherence calculator using the first and second directivity signals to obtain a coherence value;

a targeted voice section detector determining, based on the coherence value, whether the temporal section is a targeted voice section, in which the plurality of signals arrive from a targeted direction, or an untargeted voice section, in which the plurality of signals arrive from an untargeted direction different from the targeted direction;

a coherence behavior calculator maintaining an average of all coherence values determined to correspond to the untargeted voice section, and upon detecting that an instantaneous coherence value obtained by the coherence calculator corresponds to the untargeted voice section, obtaining a difference between the instantaneous coherence value and the average;

a Wiener filter (WF) adapter comparing the difference obtained in the coherence behavior calculator with a predetermined threshold, and upon detecting that the difference is smaller than the threshold, determining that the temporal section is a background noise section that substantially contains no voice signal, and using signal characteristics of the signals in the background noise section to update a WF coefficient; and a WF coefficient multiplier multiplying the first input signal by the WF coefficient from the WF adapter.

12. The non-transitory computer-readable medium of claim 11, wherein the coherence calculator calculates the coherence value using $$COH = \sum_{f=0}^{M-1} coef(f)/M,$$

COH is the coherence value, $$coef(f) = \frac{|B_1(f) \cdot B_2(f)^*|}{\frac{1}{2}\{|B_1(f)|^2 + |B_2(f)|^2\}},$$

$B_1(f)$ and $B_2(f)$ are respectively the first and second input signals, $B_2(f)^*$ is a complex conjugate of $B_2(f)$, and M is a maximum of frequency f.

* * * * *